United States Patent [19]

Yamada

[11] 4,235,554

[45] Nov. 25, 1980

[54] KEYBOARD SIGNAL STORAGE MECHANISM

[75] Inventor: Michihiro Yamada, Kodaira, Japan

[73] Assignee: Silver Seiko Limited, Kodaira, Japan

[21] Appl. No.: 961,210

[22] Filed: Nov. 16, 1978

[30] Foreign Application Priority Data

Dec. 2, 1977 [JP] Japan ..... 52-144038

[51] Int. Cl.[3] ..... B41J 23/02

[52] U.S. Cl. ..... 400/52; 400/300; 400/478

[58] Field of Search ..... 400/52, 478, 300

[56] References Cited

U.S. PATENT DOCUMENTS

| | | | |
|---|---|---|---|
| 3,086,635 | 4/1963 | Palmer | 400/52 |
| 3,718,243 | 2/1973 | Chvatlinsky | 400/52 |
| 3,721,327 | 3/1973 | Van Der Werf et al. | 400/52 |
| 3,817,366 | 6/1974 | Blum | 400/52 X |
| 3,827,542 | 8/1974 | Blum | 400/52 |

*Primary Examiner*—Clifford D. Crowder
*Attorney, Agent, or Firm*—Armstrong, Nikaido, Marmelstein & Kubovcik

[57] ABSTRACT

A coded electric signal generating keyboard for a single element typewriter is disclosed which has a keylever signal storing function and includes an interlock mechanism for permitting only one interposer at a time to be moved out of its normal position. Thus after depression of a particular key another key is prevented from being depressed until the interposer moved to an operative position is restored to the normal position during an initial part of a printing cycle initiated in response to depression of the particular key. It further includes an arresting mechanism operable to arrest another subsequently released interposer to an intermediate stored position during the remaining part of the printing cycle whereby another printing cycle may be initiated at the end of such printing cycle.

4 Claims, 10 Drawing Figures

KEYBOARD SIGNAL STORAGE MECHANISM

BACKGROUND OF THE INVENTION

This invention relates to an improved keyboard mechanism for a single element typewriter or printer, and more particularly to a keylever signal storage mechanism for storing and typing the character according to a key which is depressed prior to the completion of a printing cycle of a previously depressed key.

A single element typewriter or printer has been already proposed wherein a keyboard generates coded electric signals for controlling an electromechanical character selection apparatus to select a character on the single print element in accordance therewith, and conventionally, a cyclically operable drive means is rendered operative in response to depression of a key to activate such electromechanical character selection apparatus as well as a printing means for actuating the print element to impact the selected character against the typewriter platen. In such typewriters, a key operable interposer is conventionally unlatched upon depression of a key to move from a normal position of rest to an operative position. Coding means is actuated to generate coded electric signals and then the cyclically operable drive means initiates its power driven operations, whereafter the interposer is restored to the normal rest position by a suitable restoring means driven by the drive means. Such sequence of operations is thus significantly different from that of a conventional single element typewriter such as disclosed in, for example, U.S. Pat. No. 2,919,002.

In order to obtain a high average typing speed, a single element typewriter or printer is conventionally provided with a mechanical storage means whereby a key signal after a preceding key has been depressed is stored until the preceding print cycle has been completed, then the stored signal automatically initiates another print cycle. Various proposals have been made to provide such mechanical storage means, but due to sequential differences of operations, only a few of them are applicable to a single element typewriter which has coding means and electromechanical character selection means as mentioned above.

U.S. Pat. No. 3,721,327 discloses a suitable keylever signal storage means applicable to such typewriters which includes, in addition to a first locking means to permit only one first interposer at a time to move to its actuated operative position, a second locking means to permit only one second interposer at a time to move to its operative position and to hold another subsequently released second interposer in an intermediate stored position. In response to restoration of a second interposer from the operative to the normal position towards the end of the print cycle the subsequently released second interposer is moved from the intermediate stored to the operative position thereby initiating another print cycle. The disclosed storage means, however, is disadvantageous in that a second depression of a key during the print cycle initiated by a first depression of the key may be ignored by the machine because of a sequence of machine operations in which the second interposer and accordingly the first interposer are not restored to their respective normal positions till the end of the print cycle. Such sequence of operations is inevitable due to the constitution of the storage means that engagement of a second interposer with the second locking means enables the latter to hold another subsequently released second interposer to the intermediate stored position.

Moreover, according to the disclosed storage means, there must necessarily be a complicated vertical and horizontal interconnection between a first interposer and a corresponding second interposer. Such interconnection means that downward movement of the first interposer to the actuated position depresses and releases the second interposer from latch means thereby permitting same to be moved by a spring in a horizontal direction to the operative position and into engagement with the second locking means. Upon such movement of the second interposer to the operative position, the first interposer is moved thereby in the horizontal direction out of engagement with the first locking means while it is held in the actuated position and in engagement with the first locking means by the second interposer in the intermediate stored position.

Such complicated interconnection is established by interchanging lugs formed on the first and second interposers and is disadvantageous in that it requires strict accuracy of parts and assemblage or otherwise the signal storing feature will be damaged. For example, a first interposer is disengaged from the first interlocking means by a corresponding second interposer in the intermediate stored position thereby permitting another first interposer to be moved to the actuated position. Another corresponding second interposer is permitted to move to the intermediate stored position whereby any number of second interposers may be brought to the intermediate stored position.

SUMMARY OF THE INVENTION

Accordingly, an object of the present invention is to provide a keylever signal storage mechanism for a typewriter or printer which obviates such disadvantages of the prior art.

Another object of the invention is to provide an improved keylever signal storage mechanism for a single element typewriter or printer which can be incorporated in a keyboard which outputs coded electric signals in accordance with the depressed key.

A keylever signal storage mechanism according to the present invention comprises interposer latch means, a plurality of interposers each having a normal position latched by the interposer latch means and spring urged to an operative position. Each interposer is released from the normal position by depression of a key to move to the operative position thereby initiating a cycle of operations of cyclically operable drive means and typing means for printing a character in accordance with the depressed key. Interlock means for permitting only one interposer at a time to be moved out of the normal position, restoring means operable during an initial part of a printing cycle initiated by movement of an interposer to the operative position to restore the interposer to the normal position thereby permitting another interposer to be moved out of the normal position. Arresting means operable during the remaining part of the print cycle to arrest another subsequently released interposer to an intermediate stored position whereby a second print cycle may be initiated at the end of the print cycle.

The foregoing and other objects, features and advantages of the invention will be apparent from the following preferred embodiment of the invention, as illustrated in the accompanying drawings.

DESCRIPTION OF THE PREFERRED EMBODIMENT

Figure 1:
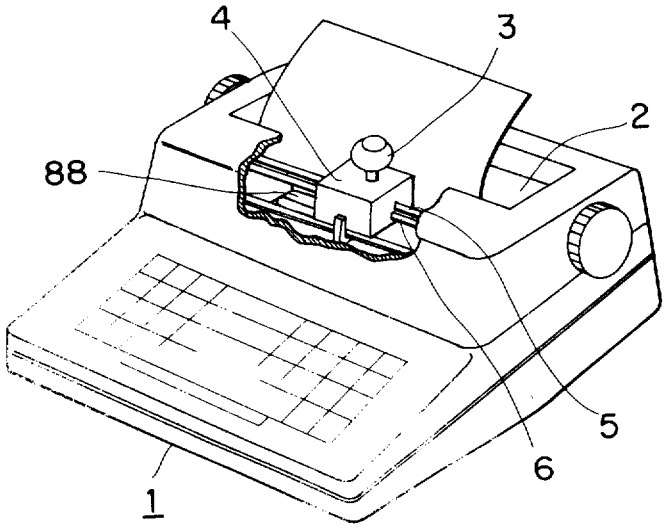
FIG. 1 is a partly broken perspective view of a single element typewriter.

Referring to FIG. 1, there is illustrated a single element typewriter having a keyboard which includes a keylever signal storage mechanism embodying the present invention. The typewriter includes a stationary platen 2 along which a movable print carrier 4 is translated on a print shaft 5. The print shaft 5 provides the driving forces to the carrier 4 to cause activation of a single element print head 3 carried on the carrier 4. The print element 3 is adapted to be rotated and tilted in accordance with control signals transmitted from the keyboard 1 to the carrier 4 by means of control signal lines 88 to present a desired character thereon in position opposite the platen 2 such that the character is typed on a paper supported on the platen 2.

Figure 9:
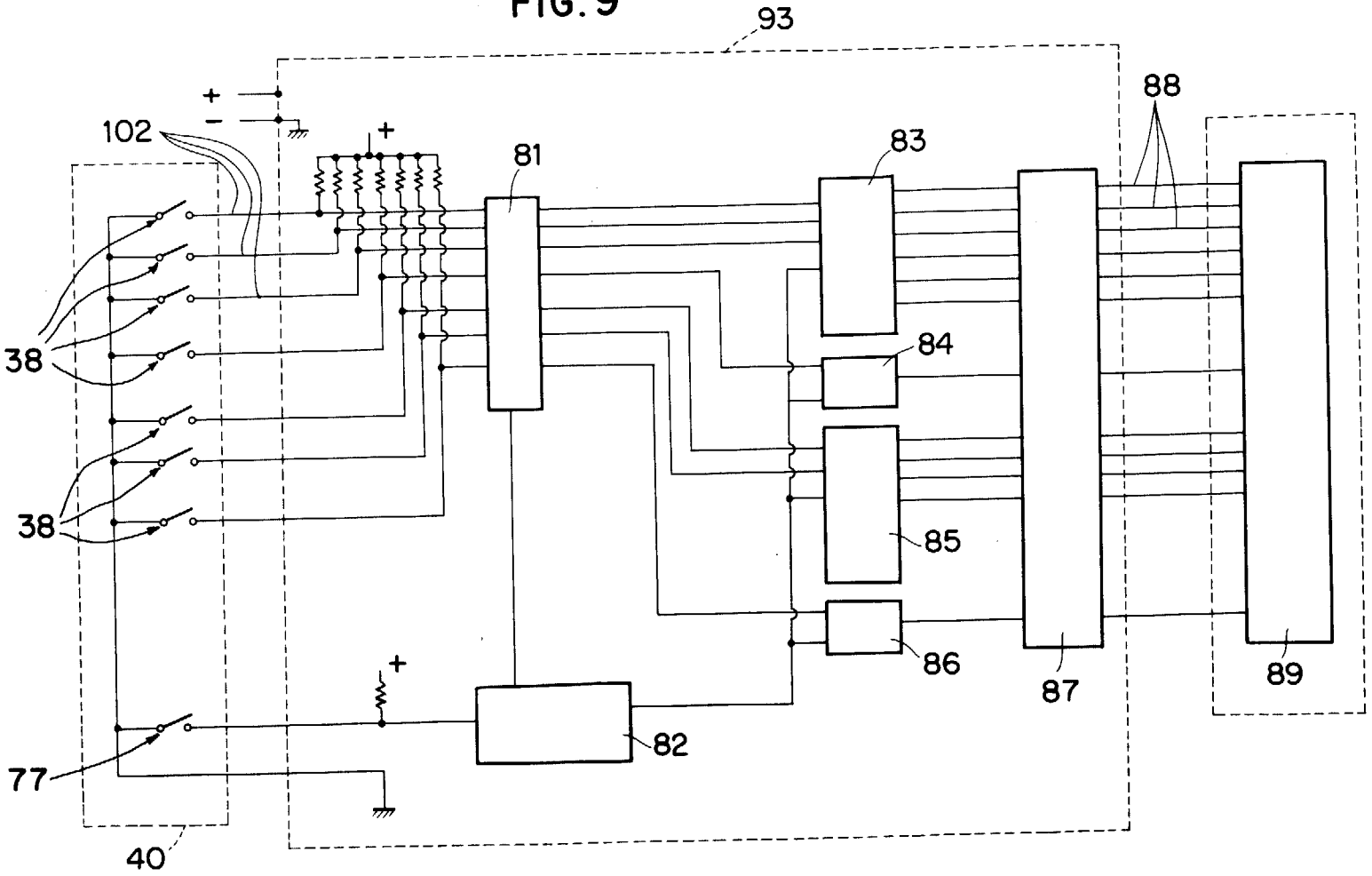
FIG. 9 is a circuit diagram showing one form of a control circuit means for control of a character selection mechanism in accordance with electric signals obtained from the switch unit provided to the keyboard.

Since such control signals which are provided by control circuit means, generally designated by reference 93 in FIG. 9, are designed to be best suited for control of an electromechanical character selection mechanism disclosed in U.S. patent application Ser. No. 889,406, which is assigned to the assignee of the present patent application, the typewriter shown is hereinafter described as being provided with such character selection mechanism.

The character selection mechanism includes a case shift shaft 6 disposed in parallel with the print shaft 5, and an actuator block generally designated by reference 89 in FIG. 9 which includes a plurality of electromagnets selectively energizable in accordance with the electric control signals transmitted thereto from the control circuit means 93. Thus, the keyboard 1 is provided with a switch unit 40 (FIGS. 3 and 9) for generating electric signals representative of the character to be printed.

Figure 2:
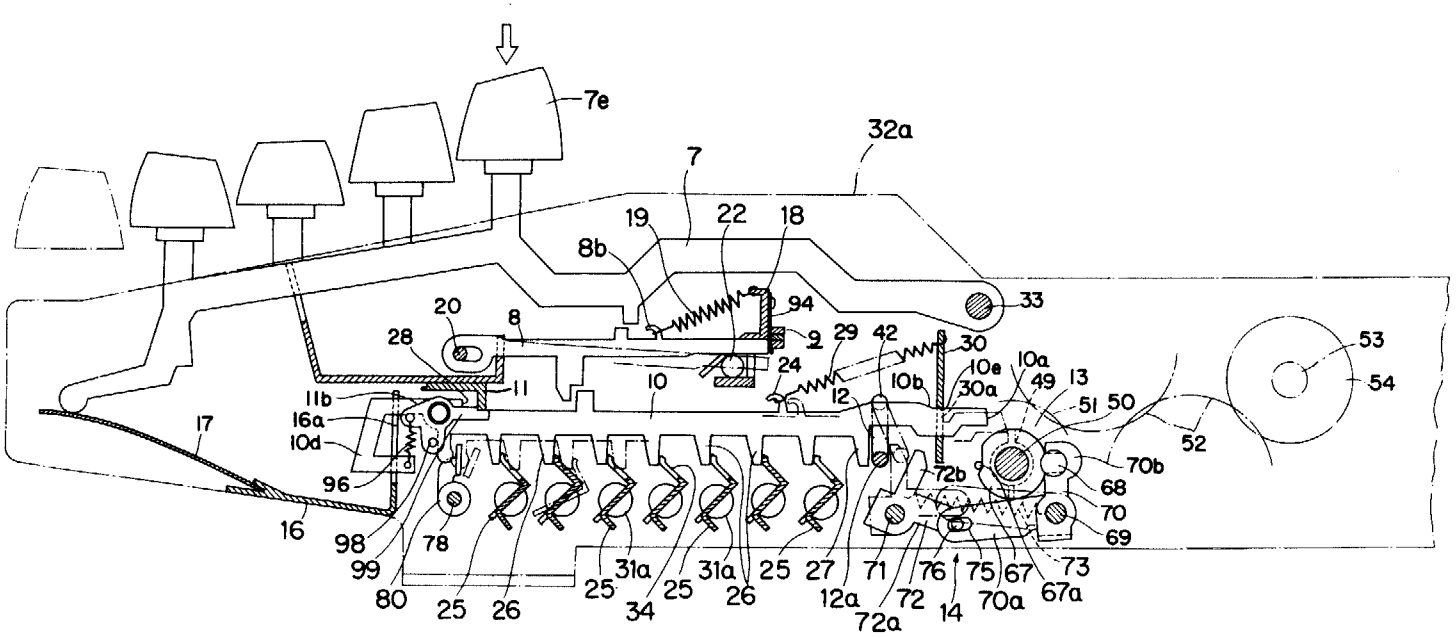
FIG. 2 is a vertical section through the typewriter keyboard having a keylever signal storage mechanism embodying the present invention.
Figure 5A:
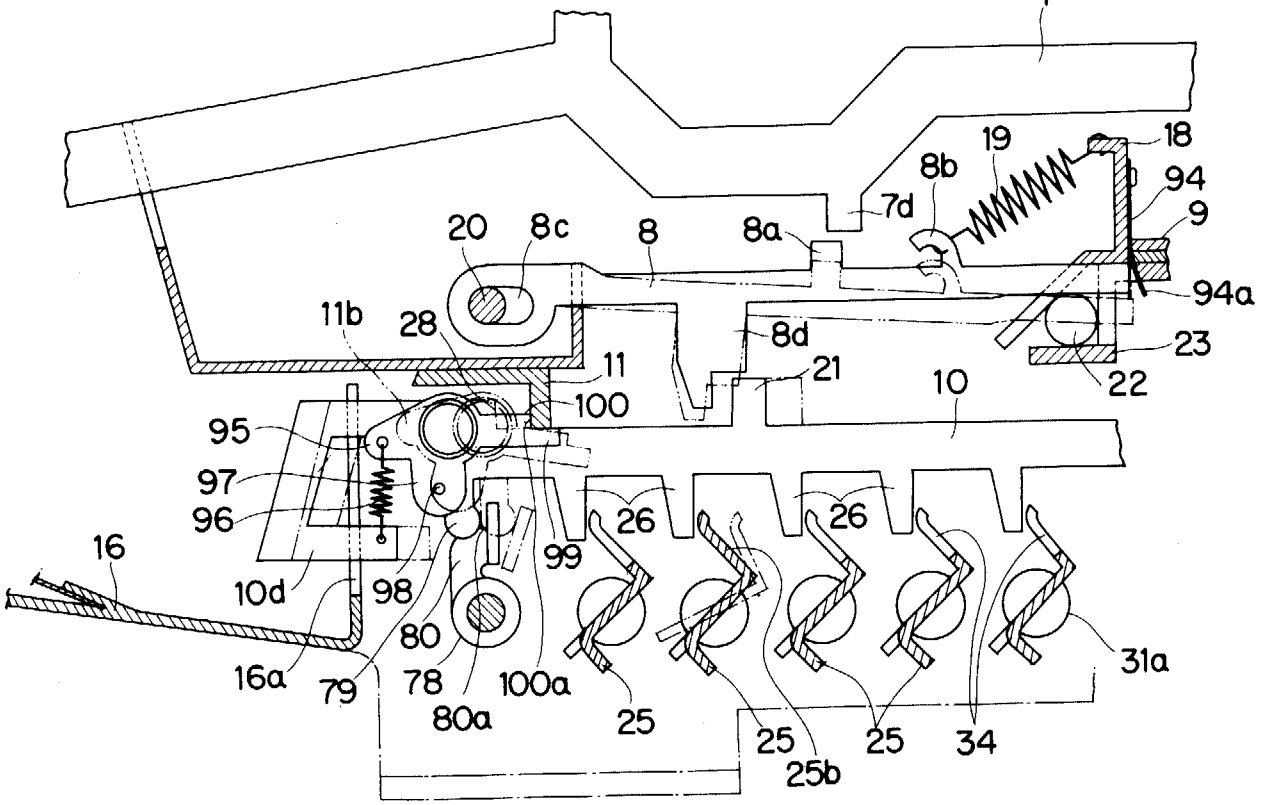
FIG. 5A is an enlarged detail view of part of FIG. 2.

Referring now to FIGS. 2 and 5A, the keyboard 1 comprises a plurality of keylevers 7 having their own key buttons 7*e*. The keylevers 7 are pivotally mounted on a fulcrum rod 33 which extends transversely between the side walls 32*a* and 32*b* (FIG. 3) of a machine frame and are urged clockwise to a normal position of rest by fingers of a spring comb 17 attached to a bracket 16. Each keylever 7 has a downwardly extending finger 7*d* adapted to be engaged with a finger 8*a* of a corresponding first interposer 8.

The first interposers 8 are pivotally supported on a fulcrum rod 20 extending transversely between the side walls 32*a* and 32*b* in such a manner that each interposer 8 can both be pivoted clockwise about the fulcrum rod 20 and slidably translated within the limits defined by a slotted opening 8*c* formed therein. A spring 19 extended between a hook 8*b* formed on each first interposer 8 and a bracket 18 mounted on the machine frame urges the corresponding interposer 8 counterclockwise about the fulcrum rod 20 to a normal position of rest in which the first interposer 8 is not engaged with a corresponding second interposer 10 and the rod 20 is abutted against the forward (left as viewed in FIGS. 2 and 5A) end of the slotted opening 8*c* of the first interposer 8.

Thus, when a keylever 7 is depressed, the finger 7*d* thereon is engaged with the finger 8*a* on a corresponding first interposer 8 to pivot the latter clockwise about the rod 20 from the normal position to an actuated position as shown in full line and a phantom line, respectively, in FIGS. 2 and 5A.

An interlock means is provided for preventing the simultaneous actuation of more than one first interposer. In the present embodiment, conventional type of ball interlock is employed, which is generally designated by reference 9 and includes a plurality of steel balls, one of which is shown at 22, contained in a channel defined by a casing member 23 and a lower bent portion of the bracket 18. The first interposers 8 extend across the channel through slits formed in the bracket 18 and also in the casing member 23 to allow a portion of each interposer 8 to engage with a pair of adjacent balls 22 of the interlock 9. Thus, one interposer 8 in the actuated position prevents another interposer 8 from being lowered to the actuated position thereby preventing simultaneous actuation of more than one interposer 8.

Attached to the bracket 18 is a leaf spring latch member 94 having a plurality of downwardly extending latch fingers 94*a* which are normally abutted against the rear ends of the corresponding first interposers 8 in the normal position and urge the respective interposers 8 in the forward direction. When a first interposer 8 is pivoted to the actuated position, a corresponding finger 94*a* of the latch spring 94 snaps to the top of a rear end portion of the interposer 8 to latch the latter to the actuated position. If the interposer 8 is thereafter translated forwardly (leftwardly as viewed in FIGS. 2 and 5), it is released from the latch finger 94 so that it may be restored to the normal position by means of the spring 19.

Each interposer 8 has a downwardly extending shouldered finger 8*d* adapted to be engaged with a finger 21 formed on a corresponding second interposer 10. The second interposers 10 are accommodated at their front ends in slits 16*a* formed in the guide bracket 16 and at their rear ends in slits 30*a* formed in another guide bracket 30 whereby they are each disposed for translatory rearward movement from a normal position of rest as shown in full line in FIG. 2 and also for movement in a vertical plane in which the second interposer 10, a corresponding first interposer 8 and a corresponding keylever 7 are arranged.

Each second interposer 10 has a plurality of, seven in the embodiment, downwardly extending selecting teeth 26 which will act to rock predetermined selecting bails 25 about their pivot members 31*a* and 31*b* (see also FIGS. 3 and 4) attached to both ends thereof and pivotally supported by the side walls 32*a* and 32*b*, respectively. The pivot members 31*a* and 31*b* are preferably molded with a suitable synthetic resin material such as a polyacetal resin. Each pivot member 31*a* has an upwardly extending finger 35 at the outer end thereof (FIG. 4) while each pivot member 31*b* has an upwardly extending notched finger 37 at the outer end thereof (FIG. 5B). Each finger 37 is adapted to receive at its notch portion 39 a contact lever 38*b* of the switch unit 40 for actuation of the contact lever 38*b*, as will be described later. The first, third, fifth, and seventh selecting bails 25, as numbered from the left in FIGS. 2 and 5B, are each urged counterclockwise about the respective pivot members 31*a* and 31*b* to a normal position of rest by an overcenter spring 74*b* having one end connected to the end of the notched finger 37 and the other end to the right side wall 32*b* while the remaining selecting bails 25 are each urged counterclockwise (as viewed in FIG. 2) to a normal position of rest by an overcenter spring 74*a* (FIG. 4) having one end connected to the end of the finger 35 and the other end to the left side wall 32*a*. The alternate arrangement of the springs 74*a* and 74*b* prevents possible interference with each other when some of the selecting bails 25 are rocked about the pivot members 31*a* and 31*b*.

The selecting bails 25 have adjacent to the selecting teeth 26 of the second interposers 10 notches 34 and solid portions 25*b* in predetermined different arrangements so that any number of selecting bails 25 (up to seven) may be rocked about their pivot members 31*a* and 31*b*. Selective rocking motions of the selecting bails 25 will operate the switch unit 40 to generate coded electric signals for selecting a different character on the single element print head 3, as hereinafter described in detail.

Each second interposer 10 is urged in the rearward direction and also in the upward direction by a spring 29 extended between a hook 24 formed thereon and the guide bracket 30, whereby an upper rear end portion 10*e* thereof abuts against the top of the slit 30*a* of the guide bracket 30. The second interposer 10 is thus urged clockwise about the abutting portion 10*e* by the spring 29.

In FIG. 5A a fixed latch member 11 which extends transversely of the machine is normally engaged with forward top portions of the second interposers 10 to prevent upward pivotal motion of the latter about their contact portions 10*e*. Translatory movement of each second interposer 10 in the rearward direction is normally prevented by the fixed latch member 11 which normally engages at its lower front surface with a movable latch member 11*b* at the rear end surface 100*a* of a shoulder 100 formed on a horizontally extending arm 99 thereof.

The movable latch member 11*b* is pivotally mounted on the second interposer 10 by a pivot and urged counterclockwise about the pivot by a spring 96 extended between a nose 95 of the movable latch member 11*b* and the end of a substantially L-shaped extension 10*d* provided at the forward end of the second interposer 10. The movable latch member 11*b* includes another downwardly extending nose 97 having a pin 98 fixed on the reverse side thereof in FIGS. 2 and 5A. The pin 98 extends laterally to be abutted against a front edge portion of another downwardly extending tooth 79 formed on the second interposer 10 forwardly of the selecting teeth 25 thereof to prevent counterclockwise pivotal motion of the movable latch member 11*b* from the position shown in full line in FIG. 5A.

If a first interposer 8 is pivoted to the actuated position, the finger 8*d* thereon is engaged with the finger 21 on a corresponding second interposer 10 to pivot the latter counterclockwise about the contact portion 10*e* whereby the movable latch member 11 is brought out of engagement with the fixed latch member 11 to release the second interposer 10 therefrom thereby permitting same to be translatorily moved in the rearward direction due to the urging by the spring 29. The second interposer 10 is stopped at an operative position as shown in phantom line in FIG. 2 due to engagement of the fixed latch member 11 with a shoulder 28 formed on the second interposer 10.

Disposed in front of and in parallel with the selecting bails 25 is a rod 78 which is rotatably supported by side walls 32*a* and 32*b* and extends below and along the row of the teeth 79 of the second interposers 10. The rod 78 is operatively connected to a letter feed mechanism of the typewriter such that an angular rotation thereof disables the letter feed mechanism to prevent a subsequent letter spacing movement of the print carrier 4 along the writing line in a printing cycle. The rod 78 has an arm member 80 mounted for rotation therewith. The arm member 80 has at its free end laterally extending lug 80*a* which is normally disposed adjacent to and in the rear of the tooth 79 of a particular interposer 10, which corresponds to a silent keylever 7 for a special character or mark such as an umlaut mark of a German letter. Thus, if the silent keylever 7 is operated and the corresponding particular interposer 10 is translatorily moved in the rearward direction, the tooth 79 thereof is engaged with the lug 80*a* of the arm member 80 to angularly rotate the arm 80 clockwise together with the rotatable rod 78 whereby the letter feed mechanism is disabled so that the carrier 4 remains stationary in its previous position.

During a rearward movement of a second interposer 10 to the operative position, the switch mechanism 40 is operated to generate coded electric signals, as briefly described above. The second interposer 10 must subsequently be restored to its normal position together with the corresponding first interposer 8 to thereby enable a subsequent depression of another keylever 7 for another character. Means for restoring both interposers 8 and 10 to their normal positions will now be described in detail, referring to FIGS. 2 to 4.

The restoring means, generally designated by reference 13, comprises a filter shaft 50 extending transversely of the machine and rotatably supported by the side walls 32*a* and 32*b*. The shaft 50 is connected to another shaft 53 by means of a gearing including a gear 51 mounted on the right end of the shaft 50 externally of the side wall 32*b*, another gear 54 mounted on the shaft 53, and suitable intermediate gears 52 between the gears 51 and 54 such that one complete revolution of the shaft 53 rotates the shaft 50 just one complete revolution. The aforementioned print shaft 5, only shown in FIG. 1, also has a gear fixed thereon which is engaged with one of the intermediate gears 52 such that a half revolution of the shaft 53 rotates the print shaft 5 one complete revolution.

The shaft 53 is connected at the left end thereof externally of the left side wall 32*a* to an electric drive motor 55 (FIG. 3) via a cycle clutch 46 and a drive train including a pulley 92*a* (FIG. 4), a belt 92, and another pulley (not shown) mounted on the output shaft of the drive motor 55. The drive train transmits the rotation of the electric motor 55 to the shaft 53 at a reduced rotational speed, and it may further include a pair of intermediate pulleys and another belt in order to further reduce transmission rotation if required. Thus, when the cycle clutch 46 is released, the shaft 53 is coupled to the drive train and driven thereby to rotate a half revolution so that the filter shaft 50 is rotated just a half revolution.

The filter shaft 50 has a diametrically arranged pair of blades 49 normally disposed in a vertical plane position as seen from FIG. 2. A second interposer 10 in the operative position as shown in phantom line in FIG. 2 has its rear end positioned in front of and adjacent to a blade 49 of the filter shaft 50 in the normal position so that, when the clutch 46 is released and the shaft 50 is rotated a half revolution in the counterclockwise direction in FIG. 2, the blade 49 is engaged with the interposer 10 at its rear end 10*a* to move same in the forward direction towards the normal position to which it is again latched by the latch member 11 engaged with the movable latch member 11*b* on the interposer 10. During such forward movement of the interposer 10, the front face of the finger 21 thereon is engaged with the rear face of the lower finger 8*d* on the first interposer 8 latched to the actuated position to push same in the forward direction thereby to release same from the latch finger 94*a*. The first interposer 8 is thus permitted to return to its normal rest position due to the urging by the spring 19 to be disengaged from the ball interlock 9 thereby to enable another first interposer 8 to be lowered to the actuated position, thus enabling depression of another keylever 7.

Means is provided operable in response to translatory rearward movement of a second interposer 10 to the operative position for releasing the cycle clutch 46 thereby to effect the restoration of the interposer 10 to the normal position. Such means comprises a downwardly extending additional tooth 27 formed on each second interposer 10 in the rear of and adjacent to the teeth 26 of the second interposers 10. The cross bar 12*a* of the universal bail 12 is offset from the ends, of which one is shown at 42 in FIG. 2, and the ends 42 are rotatably supported in the left and right side walls 32*a* and 32*b* (see FIG. 3). Thus, if a second interposer 10 is moved in the rearward direction to the operative position, the tooth 27 will be brought into engagement with the cross bar 12*a* of the universal bail 12 to pivot the latter counterclockwise (as viewed in FIG. 2) about the ends 42.

Figure 3:
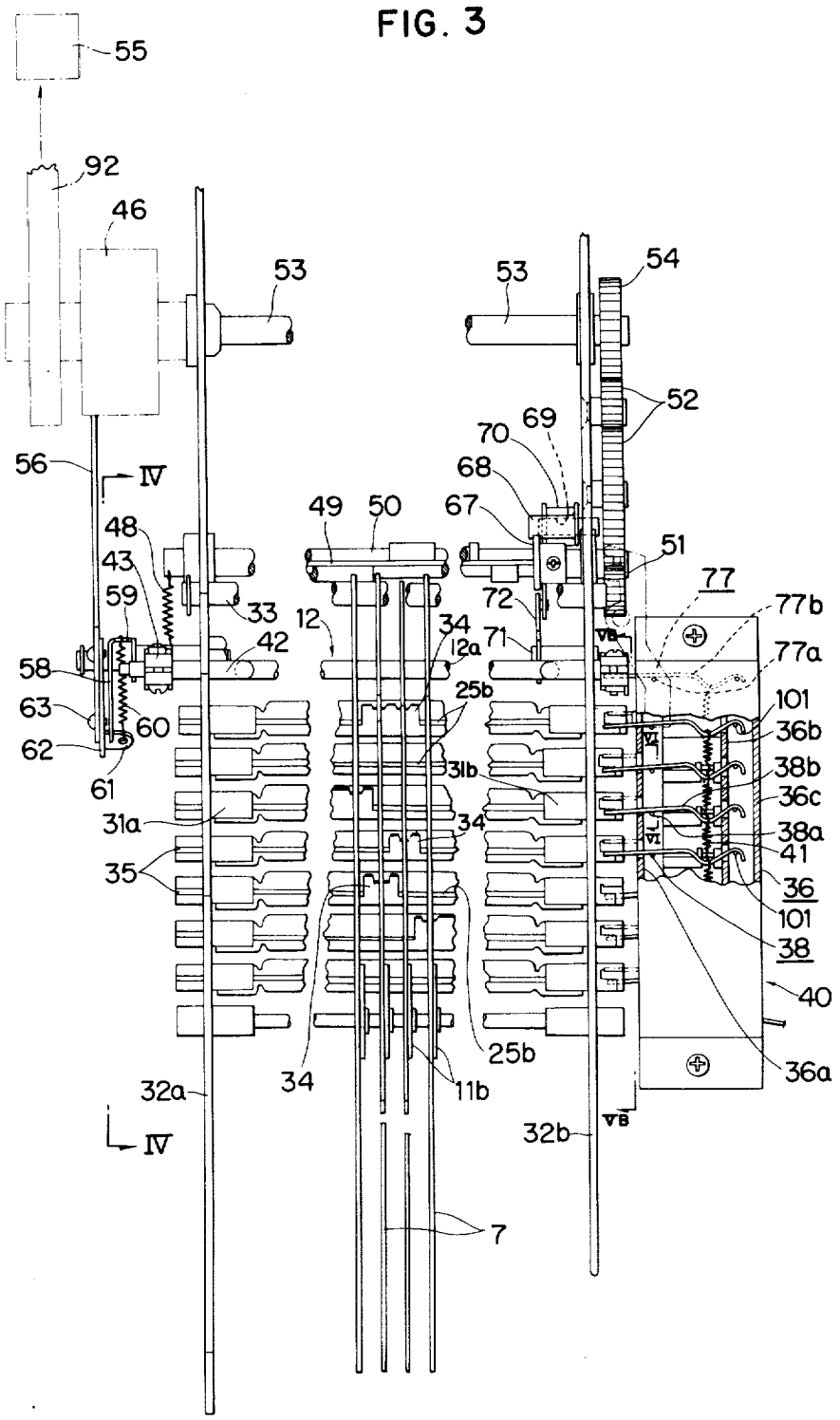
FIG. 3 is a top plan view of the keyboard with several parts omitted and partly in section, illustrating a horizontal disposition of components of the typewriter.
Figure 4:
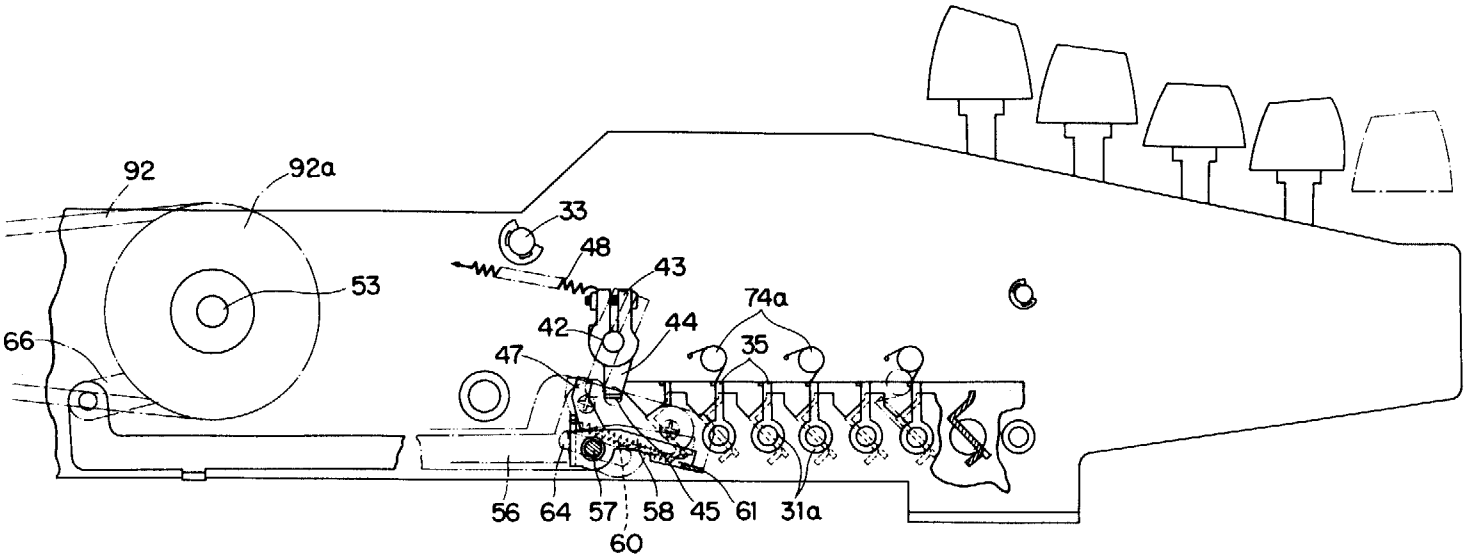
FIG. 4 is a vertical section taken along line IV—IV of FIG. 3.
Figure 5B:
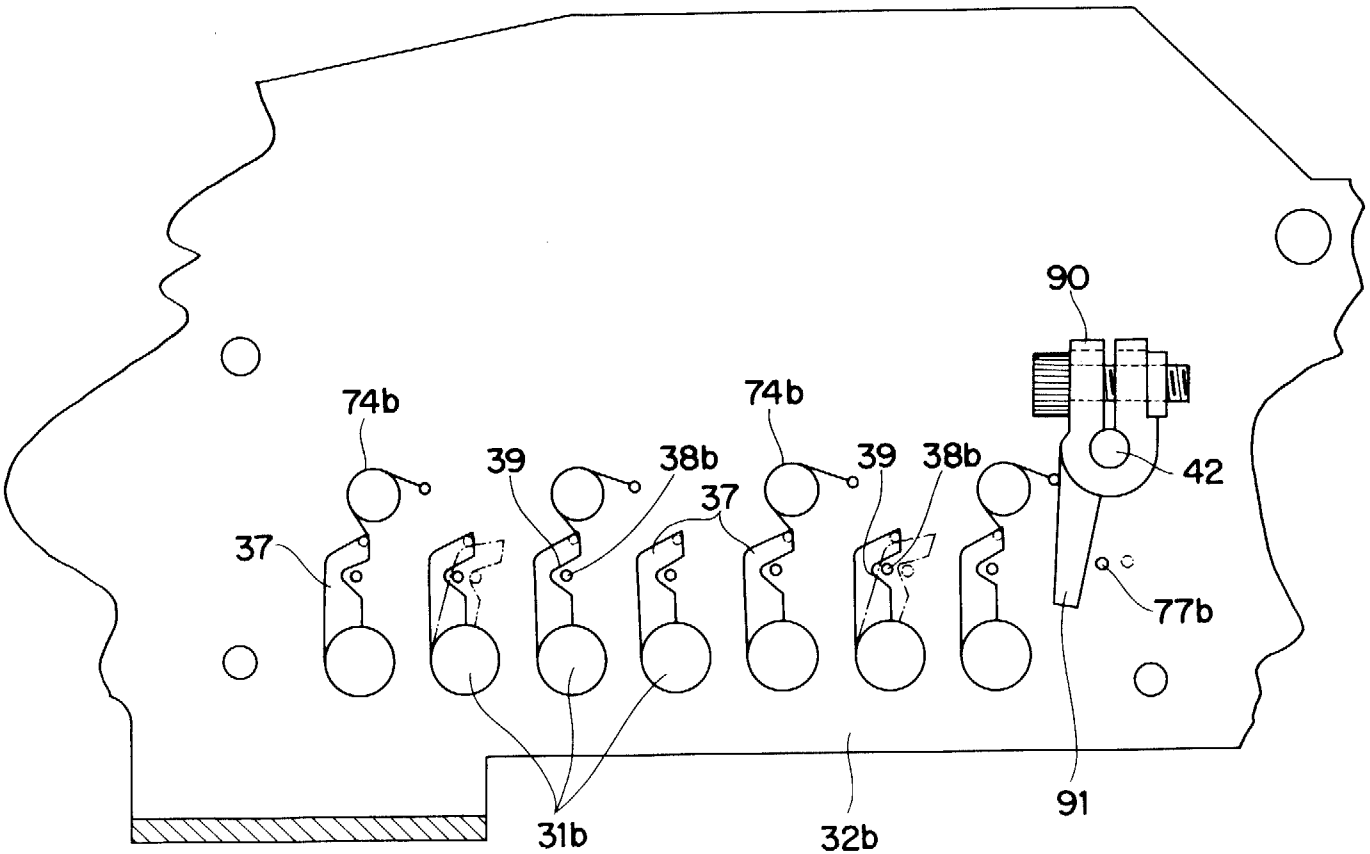
FIG. 5B is an enlarged vertical section taken along line VB—VB of FIG. 3.

Referring to FIGS. 3 and 4, a collar lever 43 is fixed on an outer extension of the left end 42 of the universal bail 12. A spring 48 urges the lever 43 and accordingly the bail 12 counter clockwise about the ends 42 as viewed in FIG. 4. The lever 43 includes a downwardly extending arm 44 having a laterally extending lug 45 adapted to engage with an upwardly extending arm of a bellcrank 47. The bellcrank 47 is pivotally mounted on a pivot 57 fixed on the side wall 32*a*.

Disposed adjacent to the bellcrank 47 is a link 56 having an elongated slotted opening 64 (FIG. 4) which accommodates the pivot 57 to allow a substantially translatory movement of the link 56 in the rearward (leftward as viewed in FIG. 4) direction. The link 56 has an adjustable member 62 adjustably fixed thereon by a pair of fastening screws 63. The member 62 has a laterally extending lug 61 normally underlying the shouldered end of another arm 58 of the bellcrank 47. A spring 60 extended between an intermediate portion 59 of the bellcrank 47 and the lug 61 of the member 62 urges the member 62 and accordingly the link 56 in the rearward direction. Rearward movement of the link 56 is prevented by engagement of the lug 61 of the member 62 with the shouldered arm 58 of the bellcrank 47. The link 56 has a clutch trigger member 66 (FIG. 4) pivotally mounted at the rear end thereof. The trigger 66 is adapted to release the clutch 46 to connect the shaft 53 to the drive train.

If a second interposer 10 is translated to rock the universal bail 12 clockwise (as viewed in FIG. 4) about the ends 42, the lever 43 is rocked clockwise therewith to bring the lug 45 thereon into engagement with the upwardly extending arm of the bellcrank 47 to pivot the latter counterclockwise about the pivot 57 whereby the bent lug 61 of the member 62 is released from the shouldered arm 58 of the bellcrank 47. The link 56 is thus permitted to translate in the rearward direction due to the urging by the spring 60 to operate the clutch trigger 66 thereby to release the cycle clutch 46 whereby the shaft 53 is permitted to be driven to rotate a half revolution by the motor 55 through the drive train and the clutch 46.

Towards the end of such revolution of the shaft 53, conventional means comprising a cam (not shown) mounted on the shaft 53 restores the trigger 66 and accordingly the link 56 to their respective initial positions. Thus, the link 56 is latched again by the shouldered arm 58 of the bellcrank 47 in its initial position to which it has already been restored by the spring 48 having been rendered effective after the translated second interposer 10 was restored to the normal position.

In order to prevent the switch mechanism 40 from being operated after restoration of a previously operated first interposer 8 and a corresponding second interposer 10 during a printing cycle initiated by depression of a corresponding keylever 7, the typewriter is provided with cyclically operable arresting means for arresting a second interposer 10, if it is subsequently operated, to an intermediate stored position for a required period of time.

Referring to FIGS. 2 and 3, the arresting means generally designated by reference 14 includes a cam member 67 mounted for rotation with the filter shaft 50. A cam follower stud 68 is adjustably fixed on an arm 70*b* of a cam follower bellcrank 70 which is pivotally mounted on a fulcrum pin 69 fixed on the right side wall 32*b*. The bellcrank 70 is articulately connected to another bellcrank 72 by means of a pin and slot connection including a pin 76 fixed on an arm 72*a* of the bellcrank 72 and an elongated slot 75 formed in another arm 70*a* of the bellcrank 70. The bellcrank 72 is pivotally mounted on a pin 71 fixed on the right side wall 32*b*. A spring 73 extended between another arm 72*b* of the bellcrank 72 and the fulcrum pin 69 urges the bellcrank 72 clockwise about the pin 71 to a normal position in which the arm 72*b* is angularly spaced apart from the universal bail 12 as shown in full line in FIG. 2. The cam follower bellcrank 70 is thus urged by the spring 73 counterclockwise about the pin 69 to usually contact the cam follower stud 68 thereon with the cam profile of the cam member 67 on the filter shaft 50.

The cam follower stud 68 is normally engaged with one of a pair of diametrically disposed low dwells 67*a* of the cam profile of the cam member 67, as shown in FIG. 2. During rotation of the filter shaft 50, the cam follower bellcrank 70 is first rocked by the action of the cam 67 clockwise about the pin 69 to rock the bellcrank 72 counterclockwise about the pin 71 to a position as shown in phantom line in FIG. 2 in which the arm 72*b* thereof is positioned adjacent to the cross bar 12*a* of the universal bail 12 now in its normal position. The universal bail 12 has been permitted to return to the normal position by the spring 48 (FIG. 4) resultant to the restoration of a previously operated second interposer 10 to its normal position by the aforementioned means 13. The bellcranks 70 and 72 are then held in such respective rocked positions until they are finally permitted, towards the end of the rotation of the shaft 50, return to respective normal positions. The cam follower stud 68 of bellcrank 70 is now engaged with the other low dwell 67*a* of the cam member 67 in its normal position as shown in FIG. 2.

If another keylever 7 is depressed while the universal bail 12 is arrested in the normal position by the bellcrank 72, a corresponding first interposer 8 is rocked to the actuated position in which it will be thereafter held by the latch finger 94*a*, and a corresponding second interposer 10 is rocked to be released from the latch 11, whereby it is translatorily moved a very small distance to an intermediate position in which the rearmost tooth 27 thereon is abutted by the cross bar 12*a* of the universal bail 12 arrested in the normal position. The second interposer 10 will thereafter follow the universal bail 12 so that it is arrested in the intermediate position for a required period of time and then permitted to move to the operative position towards the end of the previous printing cycle, that is, the end of the rotation of the cam 67 with the filter shaft 50. Thus, depression of a second keylever 7 during a printing cycle initiated by depression of a first keylever 7 is stored by a corresponding second interposer 10 arrested in the intermediate position by the arresting means 14 until a second printing cycle is permitted to start at the time of the completion of the first printing cycle.

Figure 6:
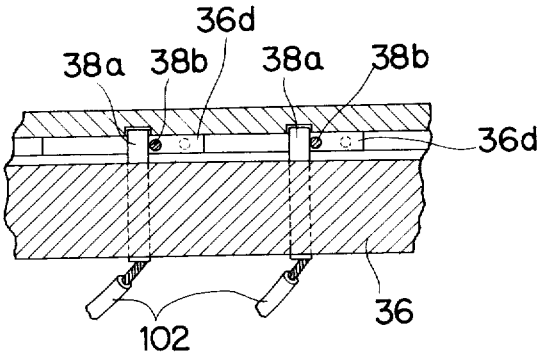
FIG. 6 is another enlarged vertical section taken along line VI—VI of FIG. 3.

Now, description will be given in detail of the switch unit 40, referring to FIGS. 3, 5B and 6. The switch unit 40 is adjustably mounted on a base portion (not shown) of the machine frame and located adjacent to and externally of the right side wall 32*b*, and includes a housing 36 having three walls 36*a*, 36*b*, and 36*c* spaced apart from each other. The unit 40 has seven switches 38 each including a fixed contact element 38*a* and a movable contact element or lever 38*b*. Each contact element 38*b* is made of a piece of curved metal wire and has at one end thereof a hook which receives a pin 101 fixed to the housing 36 to allow horizontal pivotal motion of the element 38*b* about the pin 101. Each contact lever 38*b* is urged by a spring 41 counterclockwise (as viewed in FIG. 3) about the pin 101 and normally engaged with the fixed contact element 38*a* thereby constituting a normally closed switch 38 together with the element 38*a*. The fixed contact elements 38*a* are electrically connected to the control circuit means 93 by respective lead wires 102 connected at the lower ends thereof, as shown in FIG. 6. The movable contact elements 38*b* are electrically connected to the ground by means of the pins 101 therefor and similar lead wires (not shown) attached thereto.

The movable contact levers 38*b* extend outwardly of the unit 40 towards the right side wall 32*b* through respective slotted window openings 36*d* formed in the left side wall 36*a* of the housing 36. The outer end of each movable contact lever 38*b* is normally positioned adjacent to the notch 39 of a corresponding finger 37 as mentioned before so that, when a corresponding selecting bail 25 is rocked clockwise (as viewed in FIG. 2) about the pivot members 31*a* and 31*b*, the lever 38*b* is engaged by the finger 37 on the selecting bail 25 and rocked thereby clockwise (as viewed in FIG. 3) about the pin 101. Due to the arrangement of an overcenter spring 74*a* or 74*b* and a selecting bail 25 such that when the bail 25, which is normally urged to the rest position by the spring 74*a* or 74*b*, is rocked beyond a dead center line it is urged to a rocked position which is very near to the dead center line, each spring 41 is provided with only a very weak urging force sufficient to prevail the very weak urging force of the overcenter spring 74*a* or 74*b* to rock the corresponding bail 25 from the operative position beyond the dead center line and to restore the contact lever 38*b* to its normal position. It is to be noted that such arrangement of the overcenter springs 74*a* and 74*b* is advantageous in that each second interposer 10 is urged towards its operative position by a substantially constant composite spring force composed of a prevailing force by the spring 29 in one direction and another force by the overcenter spring 74*a* or 74*b* in the opposite direction.

The switch unit 40 further includes a similar switch 77 including a fixed contact element 77*a* and a movable contact element or lever 77*b* which is also spring urged to contact with the fixed contact element 77*a* thereby constituting a normally closed switch 77, as in the aforementioned switches 38. The fixed and the movable contact elements 77*a* and 77*b* are also electrically connected to the circuit means 93 and the ground, respectively, by means of similar lead wires. The movable contact lever 77*b* also extends outwardly towards the side wall 32*b*, and is positioned adjacent to a downwardly extending arm 91 (FIG. 5B) of a collar lever 90 which is mounted on the right end 42 of the universal bail 12. Thus, when the bail 12 is rocked counterclockwise (as viewed in FIG. 5B) about the ends 42, the collar lever 90 thereon is also rocked counterclockwise to be brought into engagement with the contact lever 77*b* to rock the contact lever 77*b* clockwise (as viewed in FIG. 3) about the pin.

If a second interposer 10 is released to move from the normal rest to the operative position, some of the selecting bails 25 are selectively rocked clockwise as viewed in FIG. 2 in accordance with the arrangement of solid portions 25*b* of the bails 25 along the interposer 10 to rock the corresponding movable contact lever 38*b* to open the corresponding switches 38, thus generating coded parallel electric signals representative of the character to be typed. Meanwhile, the universal bail 12 is also rocked counterclockwise to rock the contact lever 77*b* to open the switch 77 to generate a corresponding electric signal representing that a keylever 7 is depressed. The movable contact elements 38*b* and 77*b* moved are then restored to their normal positions when the second interposer 10 is restored to the normal position.

Figure 7:
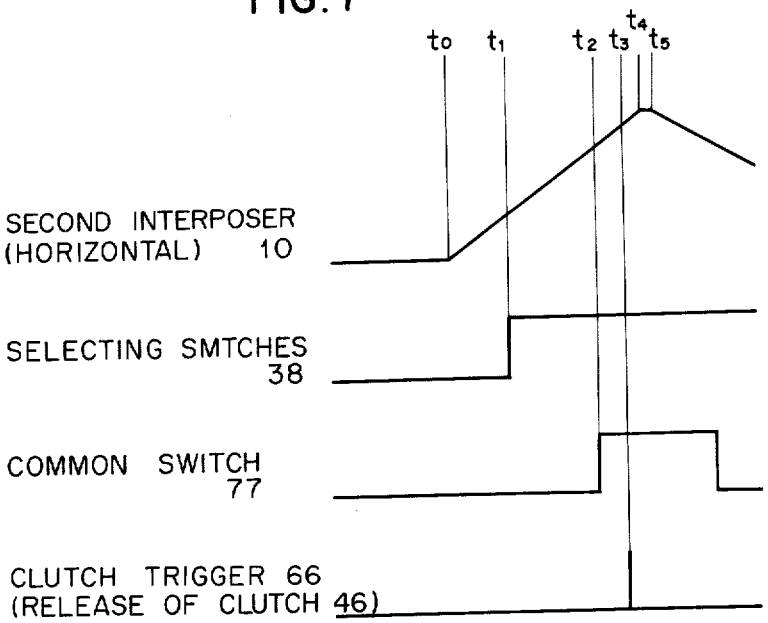
FIGS. 7 and 8 are timing charts designating the relative times at which different events may occur in the printing cycle of the machine.

FIG. 7 illustratively shows a typical sequence of movements of a second interposer 10, a selecting switch 38, the common switch 77, and the aforementioned clutch trigger 66 during a translatory movement of the interposer 10 from the normal to the operative position. After such translatory movement is initiated at time $t_o$, a selecting switch 38 is first operated to become open at time $t_1$. The common switch 77 is then operated to become open at time $t_2$ after an interval of time from time $t_1$ long enough to permit the outputs of the switches 38 to be stabilized after chattering has disappeared. The clutch trigger 66 is then operated to release the cycle clutch 46 at time $t_3$ thereby initiating a printing cycle for a character corresponding to the moved interposer 10. The translatory movement of the interposer 10 is stopped at time $t_4$ whereafter the returning movement thereof is started at time $t_5$ with a delay from time $t_3$ due to mechanical clearances in the transmission in and from the clutch 46 to the interposer 10. Unless two or more keylevers 7 are successively depressed within a very short period of time, such sequence as mentioned above is always followed even if a plurality of selecting switches 38 (up to seven) are operated. Thus, the switch unit 40 outputs coded electric signals at time $t_1$ and a particular electric signal at time $t_2$ both to the control circuit means 93, of which description is given in the following.

As has been already mentioned, the control circuit means 93 is constituted to be best suited for control of such an actuator block as is incorporated in the electromechanical character selection mechanism disclosed in the aforementioned U.S. pat. application Ser. No. 889,406, in which the single element print head is described as including up to 96 characters disposed in 24 vertical columns and 4 horizontal rows thereon. Referring to FIG. 9, the actuator block 89 includes a first set of six electromagnets and a separate electromagnet which are both adapted for rotation of the head to select a column of characters on a hemisphere thereof, and a second set of four electromagnets for tilting of the head to select a row of characters thereon. The actuator block 89 includes, however, no electromagnet for actuation of a case shift mechanism since the case shift mechanism is controlled by the case shift shaft 6 independently of the actuator block 89. On the other hand, the actuator block 89 includes another separate electromagnet which is adapted for actuation of an impression control mechanism provided for a similar purpose as described in U.S. Pat. No. 3,239,049. The control circuit means 93 has thus up to 12 output terminals connected respectively to the electromagnets in the actuator block 89 by means of respective lead wires 88.

The control circuit means 93 includes a latch memory unit 81 having seven inputs connected to the seven selecting switches 38 in the switch unit 40 by means of the respective lead wires 102, and corresponding outputs, of which three are connected to a first decoder circuit 83, another one to a first gating circuit 84, further two to a second decoder circuit 85, and the remaining one to a second gating circuit 86. The first and second decoder circuits 83 and 85 have six and four outputs respectively, connected via respective amplifiers in an amplifier unit 87 to the first and second sets of the electromagnets in the actuator block 89. The first and second gating circuits 84 and 86 are each connected via an amplifier in the unit 87 to the corresponding electromagnet in the actuator block 89.

The circuit means 93 further includes a sequencing control circuit, generally designated by reference 82, having its input connected to the common switch 77 in the switch unit 40. The sequencing control circuit 82 has a first output connected to the latch memory unit 81 to provide same with a strobe pulse to enable same to store therein input signals provided thereto from the switch unit 40. The circuit 82 has a second output connected to the circuits 83 to 86 for enabling them for a predetermined fixed period of time so that the electromagnets in the actuator block 89 will be selectively energized in accordance with the output signals of the circuits 83 to 86 for the predetermined period of time.

In operation, a set of coded electric signals are first stored in the latch memory unit 81 in response to a strobe signal from the sequencing control circuit 82 immediately after the common switch 77 in the switch unit 40 is operated. Simultaneously, the first and second decoder circuits 83 and 85 are each enabled to provide an output from selective one of respective output terminals to permit the corresponding electromagnet in the actuator block 89 to be energized. The first gating circuit 84 is also enabled to that it may provide the output to permit energization of the corresponding electromagnet. The energization of such electromagnets in the actuator block 89 will last for the predetermined period of time, which is determined to be long enough for the impacting of a selected character to be completed subsequent to the selection of the character. The second gating circuit 86 may also provide the output to actuate the impression control mechanism as above described. Another subsequent input from the common switch 77 to sequencing control circuit 82 will initiate another sequence of operations of the circuit means 93 for selection of another character in a similar manner as described above.

Figure 8:
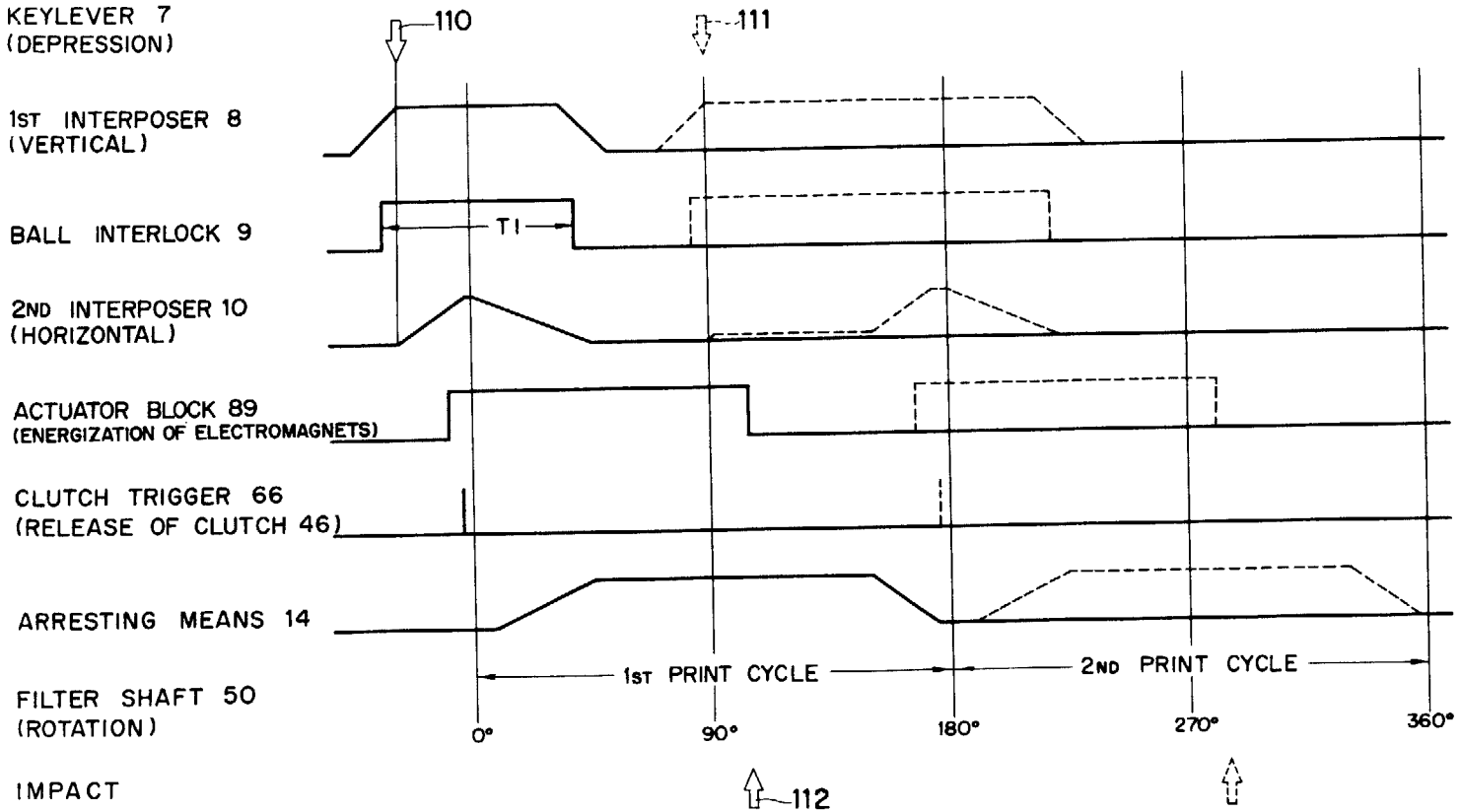

With the description having thus given of the construction of a typewriter having a keylever signal storage mechanism embodying the present invention, a description is now given of a sequence of operations of components of the machine, referring to FIG. 8 wherein the timing is laid out in angles of rotation of the filter shaft 50 of the machine where appropriate.

When a keylever 7 is depressed, a corresponding first interposer 8 is rocked to the actuated position to which it is latched by a spring latch finger **94*a*. When the interposer 8 is rocked substantially two thirds of its full rocking angle, the ball interlock 9 is rendered effective so that another interposer 8 will not thereafter be rocked to the actuated position thereby to prevent the simultaneous depression of more than one keylever 7. Rocking motion of the first interposer 8 rocks a corresponding second interposer 10 counterclockwise about the pivot point 10*e*. At the end of the rocking motion the second interposer 10 is released from the latch means 11 whereby it is translatorily moved by the spring 29 in the rearward direction to the operative position thereby to bring its rear end 10*a* into the circular path defined by the blades 49 of the filter shaft 50 to enable subsequent restoration thereof by the latter. An inclined camming portion 10*b* formed adjacent to and in front of the pivot portion 10*e* on each second interposer 10 acts to lower the rear end 10*a* thereof to assuredly bring same into the circular path of the blades 49** during such rearward movement thereof to the operative position.

Typically, a sequence of power-driven operations will be actually initiated in response to such release of a second interposer 10 to effect printing of a character on the paper supported on the typewriter platen 2. Since a keylever depression is thus rendered effective typically by the release of a second interposer 10, such keylever depression is shown in FIG. 8 by an arrow 110 indicating the time of such release.

During the rearward movement of the second interposer 10, the switch unit 40 is first operated to generate coded electric signals in accordance with the keylever 7 depressed whereby the electromagnets in the actuator block 89 are selectively energized to select a character to be printed. Energization of any electromagnet is determined to last thereafter until the filter shaft 50 is subsequently rotated at an angle of substantially 105 degrees at which the impact of the character selected is effected at time as shown by an arrow 112 in FIG. 8. Towards the end of the rearward movement of the second interposer 10, the cycle clutch 46 is released to connect the motor shaft to the clutch shaft 53 to being rotation of the filter shaft 50 and the print shaft 5 thereby initiating a sequence of power-driven operations of the typewriter.

Initial rotation of the filter shaft 50 of an angle of substantially 43 degrees moves the second interposer 10 in the forward direction from the operative position to permit same to be restored to the normal rest position to which it is again latched by the latch means 11. Arrangement of a movable latch member **11*b* on each interposer 10 under the urging by a spring 96 ensures quick latching of the interposer 10 by the latch means 11. The first interposer 8 having been latched to the actuated position is also moved forwardly due to the engagment of the rear face of the finger 8*d* thereon with the front face of the finger 21 on the second interposer 10 during substantially three fourths of the full forward stroke of the second interposer 10 at which it is released from the second interposer 10 whereby the spring 19 restores the first interposer 8 to the normal rest position, bringing same out of engagement with the ball interlock 9 to enable another keylever 7** to be depressed.

Upon the forward returning movement of the second interposer 10, the universal bail 12 is rocked by the spring 48 back to the initial position in which it is spaced apart a predetermined very small distance from the rearmost teeth 27 of the second interposers 10. The power-driven arresting means 14 is actuated substantially synchronously with the forward movement of the second interposer 10 so that a bellcrank 72 thereof is engaged with the universal bail 12 now in the initial position to thereafter hold same in that position until the filter shaft 50 is rotated to an angle of substantially 155 degrees. The arresting means 14 is thereafter permitted to return to its initial position by the spring 73 by the end of the half rotation of the filter shaft 50, that is, the end of a print cycle.

On the other hand, rotation of the print shaft 5 actuates the character selection mechanism in accordance with selective energization of the electromagnets in the actuator block 89 thereof to select a character on the single element print head 3 and then it actuates the print means to carry out the impacting of the selected character against the platen 2 to print the character on the paper supported thereon. Such impact is effected at the instant indicated by an arrow 112 which corresponds substantially 105 degrees of rotation of the filter shaft 50. The character selection mechanism and the print means are thereafter restored to their respective normal positions by the end of the half rotation of the filter shaft 50, thereby completing the print cycle initiated by the depression of a keylever 7.

According to the keylever signal storage mechanism embodying the present invention, a first interposer 8 held in the actuated position renders the ball interlock 9 effective to prevent another interposer 8 from being moved to the actuated position. Thus, another keylever 7 different from the previously operated keylever 7 cannot be depressed for such period of time T1 as shown in FIG. 8. After elapse of such period T1, the ball interlock 9 is rendered ineffective so that a different keylever 7 can be depressed as indicated by an arrow 111 in FIG. 8. Such depression of the different keylever 7 also rocks the corresponding first interposer 8 to the actuated latched position to render the ball interlock 9 effective and to rock the corresponding second interposer 10 to release same from the latch means 11, as seen from broken lines, respectively, in FIG. 8. Ths second interposer 10, however, is now moved rearwardly only a very short distance defined by the clearance between the rear most tooth 27 thereon and the cross bar **12*a* of the universal bail 12 which is arrested by the arresting means 14 to the normal position. The second interposer 10 is thus arrested by the universal bail 12 to an intermediate position thereby to mechanically store the depression of the different keylever 7 until the arresting means 14 is restored to the normal position allowing the spring 29 to move the second interposer 10 rearwardly to the operative position, which permits the clutch 46 to be released again to initiate a second print cycle consecutively to the end of the first print cycle, as seen from FIG. 8. It is obvious that a third keylever 7 can be depressed during such second print cycle after the ball interlock 9** is rendered ineffective.

What is claimed is:

1. Keylever signal storage mechanism for a typewriter or printer having a plurality of keys, a cyclically operable drive means operable in response to depression of a key, and typing means actuated by said drive means to type a character, wherein the improvement comprises interposer latch means;

a plurality of interposers each having a normal position latched by said interposer latch means and spring urged to an operative position, each interposer being released from said normal position by depression of a key to move to said operative position thereby initiating a cycle of operations of said drive means and said typing means for printing a character in accordance with the depressed key;

interlock means for permitting only one interposer at a time to be moved out of said normal position;

restoring means operable during an initial part of a print cycle initiated by movement of an interposer to said operative position to restore said interposer to said normal position thereby permitting another interposer to be moved out of said normal position; and arresting means operable during the remaining part of the print cycle to arrest another subsequently released interposer to an intermediate stored position whereby a second print cycle may be initiated at the end of the print cycle, said arresting means including a cam actuated by said cyclically operable drive means, a universal bar disposed for engagement with any of said interposers, and a cam follower linkage means interconnecting said cam with said universal bar for imparting a cam controlled motion to said universal bar.

2. Keylever signal storage mechanism as claimed in claim 1 wherein said linkage means includes a first cam follower bellcrank and a second bellcrank connected to said first bellcrank by means of a pin and slot connection, and a spring means for urging said first and second bellcranks into operative engagement with said cam and said universal bar, respectively.

3. Keylever signal storage mechanism for a typewriter or printer having a plurality of keys, a cyclically operable drive means operable in response to depression of a key, and typing means actuated by said drive means to type a character, wherein the improvement comprises;

a plurality of first interposers each spring urged to a position of rest and operable by a corresponding key to move in a first direction to an actuated position;

first latch means for latching a first interposer to said actuated position;

second latch means;

a plurality of second interposers each having a normal position latched by said second latch means and spring urged to an operative position, each second interposer being released from said normal position in response to movement of a corresponding first interposer to said actuated position to move to said operative position thereby initiating a cycle of operations of said drive means and said typing means for printing a character in accordance with the depressed keys;

interlock means for permitting only one first interposer at a time to be moved out of said normal position;

restoring means operable during an initial part of a print cycle initiated by movement of a second interposer to said operative position for restoring the second interposer to said normal position to move the corresponding first interposer in a second direction to unlatch same from said actuated position thereby to permit another key to be depressed; and arresting means operable during the remaining part of the print cycle to arrest another subsequently released second interposer to an intermediate stored position whereby a second print cycle may be initiated at the end of the print cycle.

4. Keylever signal storage mechanism as claimed in claim 3 wherein said second interposers have each a pivotal latch member mounted thereon for pivotal motion from and to a position in which it is engaged with said second latch means to retain the corresponding second interposer to said normal position, and a spring for urging said pivotal latch member to said position.

* * * * *